US009211629B2

(12) United States Patent
Kawahara

(10) Patent No.: US 9,211,629 B2
(45) Date of Patent: Dec. 15, 2015

(54) POLISHING APPARATUS

(71) Applicant: EBARA CORPORATION, Tokyo (JP)

(72) Inventor: Toshikazu Kawahara, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/173,749

(22) Filed: Feb. 5, 2014

(65) Prior Publication Data

US 2014/0220864 A1 Aug. 7, 2014

(30) Foreign Application Priority Data

Feb. 5, 2013 (JP) ..... 2013-020292

(51) Int. Cl.

| | |
|---|---|
| ***B24B 37/005*** | (2012.01) |
| ***B24B 49/08*** | (2006.01) |
| ***B24B 37/34*** | (2012.01) |
| ***B24B 37/10*** | (2012.01) |

(52) U.S. Cl.

CPC ..... *B24B 37/345* (2013.01); *B24B 37/005* (2013.01); *B24B 37/105* (2013.01); *B24B 49/08* (2013.01)

(58) Field of Classification Search

CPC B24B 37/005; B24B 37/0053; B24B 37/013; B24B 37/345; B24B 49/08

USPC ..... 451/9, 10, 11, 41, 285–289

See application file for complete search history.

(56) References Cited

U.S. PATENT DOCUMENTS

| | | | | |
|---|---|---|---|---|
| 5,245,790 | A * | 9/1993 | Jerbic | 451/159 |
| 5,246,525 | A * | 9/1993 | Sato | 156/345.12 |
| 5,527,209 | A * | 6/1996 | Volodarsky et al. | 451/388 |
| 5,816,900 | A * | 10/1998 | Nagahara et al. | 451/285 |
| 5,899,801 | A * | 5/1999 | Tolles et al. | 451/288 |
| 6,033,293 | A * | 3/2000 | Crevasse et al. | 451/494 |
| 6,102,057 | A * | 8/2000 | Vogtmann et al. | 134/144 |
| 6,482,077 | B1 * | 11/2002 | Doan et al. | 451/41 |
| 6,722,949 | B2 * | 4/2004 | Hu et al. | 451/36 |
| 6,951,597 | B2 * | 10/2005 | Korovin | 156/345.13 |
| 8,821,219 | B2 * | 9/2014 | Ahn et al. | 451/262 |
| 2006/0135047 | A1 * | 6/2006 | Sheydayi | 451/41 |
| 2007/0190788 | A1 * | 8/2007 | Balachandran et al. | 438/692 |
| 2007/0224920 | A1 * | 9/2007 | Nakagawa et al. | 451/41 |
| 2008/0146124 | A1 * | 6/2008 | Morita | 451/289 |
| 2011/0177762 | A1 * | 7/2011 | Ahn et al. | 451/339 |

FOREIGN PATENT DOCUMENTS

| | | |
|---|---|---|
| JP | 2009-178800 | 8/2009 |

* cited by examiner

*Primary Examiner* — Eileen Morgan
(74) *Attorney, Agent, or Firm* — Baker & Hostetler LLP

(57) ABSTRACT

An object of the present invention is to improve the capability of lifting a substrate with the polishing performance of the substrate maintained. A polishing apparatus 100 includes a polishing table 110 to which a polishing pad 108 for polishing a substrate 102 is attached, a liquid feeding section configured to feed a liquid 109 to a polishing surface of the polishing pad 108, a top ring 116 configured to suck and convey the substrate 102 from the polishing surface, the substrate 102 being disposed on the polishing surface via the liquid 109 fed by the liquid feeding section, and a control section configured to inject a fluid ($N_2$) into an internal area 109*a* of the liquid 109 interposed between the substrate 102 and the polishing pad 108.

1 Claim, 7 Drawing Sheets

MOVE SUBSTRATE

POLISH SUBSTRATE

PREPARE FOR LIFTING
OF SUBSTRATE

LIFT SUBSTRATE

POLISHING APPARATUS

CROSS-REFERENCE TO RELATED APPLICATION

This application claims priority to Japanese Patent Application No. 2013-020292 filed Feb. 5, 2013, the entire contents of which are hereby incorporated by reference.

BACKGROUND OF THE INVENTION

1. Field of the Invention

The present invention relates to a polishing apparatus.

2. Technical Field of the Invention

In recent years, polishing apparatuses have been used to polish surfaces of substrates such as semiconductor wafers. While rotating a polishing table to which a polishing pad (for example, a nonwoven cloth or a urethane rein) for polishing the substrate is attached, the polishing apparatus feeds a polishing and grinding liquid (slurry) onto the polishing pad. The polishing apparatus also holds the substrate by a top ring and pressurizes a back surface of the substrate to press the substrate against the polishing pad, thus polishing a front surface of the substrate.

On the other hand, when polishing of the substrate ends, the polishing apparatus uses the top ring to switch from pressurization to sucking of the back surface of the substrate. The polishing apparatus then moves the top ring upward with the substrate sucked thereto, thus lifting the substrate (elevating the substrate in a direction away from the polishing pad). This step of lifting the substrate may be carried out after the substrate is cleaned by feeding a cleaning solution such as pure water onto the polishing pad; the cleaning of the substrate follows the step of polishing the substrate.

During the step of lifting the substrate, the substrate may be left on the polishing pad and fail to be lifted. That is, after the substrate is polished, the polishing and grinding liquid or pure water is present on the polishing pad. Thus, a vacuum (negative pressure) region may be formed between the substrate and the polishing pad. In this case, under a vacuum pressure, the top ring and the substrate pull each other and the substrate and the polishing pad pull each other. If the vacuum pressure between the substrate and the polishing pad is higher than the vacuum pressure between the top ring and the substrate, the substrate may be sucked to the polishing pad and the top ring may elevate with the substrate left on the polishing pad.

In this case, as is well known, a conventional technique allows the polished substrate to be sucked to the top ring, and before lifting the substrate, slidably moves the substrate in a direction along a polishing surface of the polishing pad (a lateral direction) so that the substrate partly projects out from the polishing pad. This reduces the suction force exerted between the substrate and the polishing pad to facilitate lifting of the substrate.

As is also well known, another conventional technique increases a duration for which the substrate is sucked to the top ring to improve the suction force between the top ring and the substrate. This facilitates lifting of the substrate.

However, the conventional technique fails to take into account improvement of the capability of lifting the substrate with the performance of substrate polishing maintained.

That is, with the conventional technique of moving a part of the substrate out from the polishing pad before lifting the substrate, the substrate may fall down from the polishing pad and be damaged. Furthermore, when moved out from the polishing pad, the substrate may be scratched (flawed).

Additionally, with the conventional technique of increasing the duration for which the substrate is sucked to the top ring, a speed at which the substrate is lifted decreases to reduce the throughput of substrate polishing. This is not preferable for the polishing apparatus, which is required to efficiently process a large number of substrates.

Thus, an object of the present invention is to improve the capability of lifting the substrate with the polishing performance of the substrate maintained.

SUMMARY OF THE INVENTION

A substrate polishing apparatus according to an aspect of the embodiments has been developed with the above-described object in view and includes a polishing table to which a polishing pad for polishing a substrate is attached, a liquid feeding section configured to feed a liquid to a polishing surface of the polishing pad, a substrate holding section configured to suck and convey the substrate from the polishing surface, the substrate contacting the polishing surface via the liquid fed by the liquid feeding section, and a control section configured to inject a fluid between the substrate and the polishing pad when the substrate is being conveyed.

Furthermore, when a communication hole is formed in the polishing pad and in the polishing table to allow the polishing surface of the polishing pad to communicate with a side surface or a back surface of the polishing table, the control section can inject the fluid between the substrate and the polishing pad via the communication hole.

Additionally, when a communication hole is formed in the polishing pad to allow the polishing surface of the polishing pad to communicate with a side surface of the polishing pad, the control section can inject the fluid between the substrate and the polishing pad via the communication hole.

Additionally, the control section can inject the fluid between the substrate and the polishing pad via a nozzle provided at a position opposite to the polishing surface of the polishing pad, a position outside an outer peripheral portion of the polishing table, or a position outside an outer peripheral portion of the substrate, the nozzle being capable of discharging the fluid.

In addition, when the substrate processing apparatus includes a driving section configured to rotate the polishing table and a position detecting sensor configured to detect a rotational position of the polishing table, the control section rotates the polishing table so as to place the communication hole opposite a surface of the substrate based on the rotational position of the polishing table detected by the position detecting sensor. In this state, the control section can inject the fluid between the substrate and the polishing pad via the communication hole.

Furthermore, after the fluid is injected between the substrate and the polishing pad via the communication hole and the substrate is then conveyed, the control section can stop injecting the fluid and inject a liquid into the communication hole.

Additionally, the control section can inject the fluid into an internal area of the liquid between the substrate and the polishing pad.

In addition, the control section can inject the fluid between the polishing pad and the liquid or between the liquid and the substrate.

Furthermore, the liquid may be a polishing and grinding liquid used to polish the substrate or a cleaning solution used to clean the substrate. In addition, the fluid may be a gas.

The present invention can improve the capability of lifting the substrate with the polishing performance of the substrate maintained.

DETAILED DESCRIPTION OF THE INVENTION

A polishing apparatus according to an embodiment of the present invention will be described with reference to the drawings. In the embodiment described below, a CMP (Chemical Mechanical Polishing) apparatus will be illustrated by way of example. However, the embodiment is not limited to this polishing apparatus.

Figure 1:
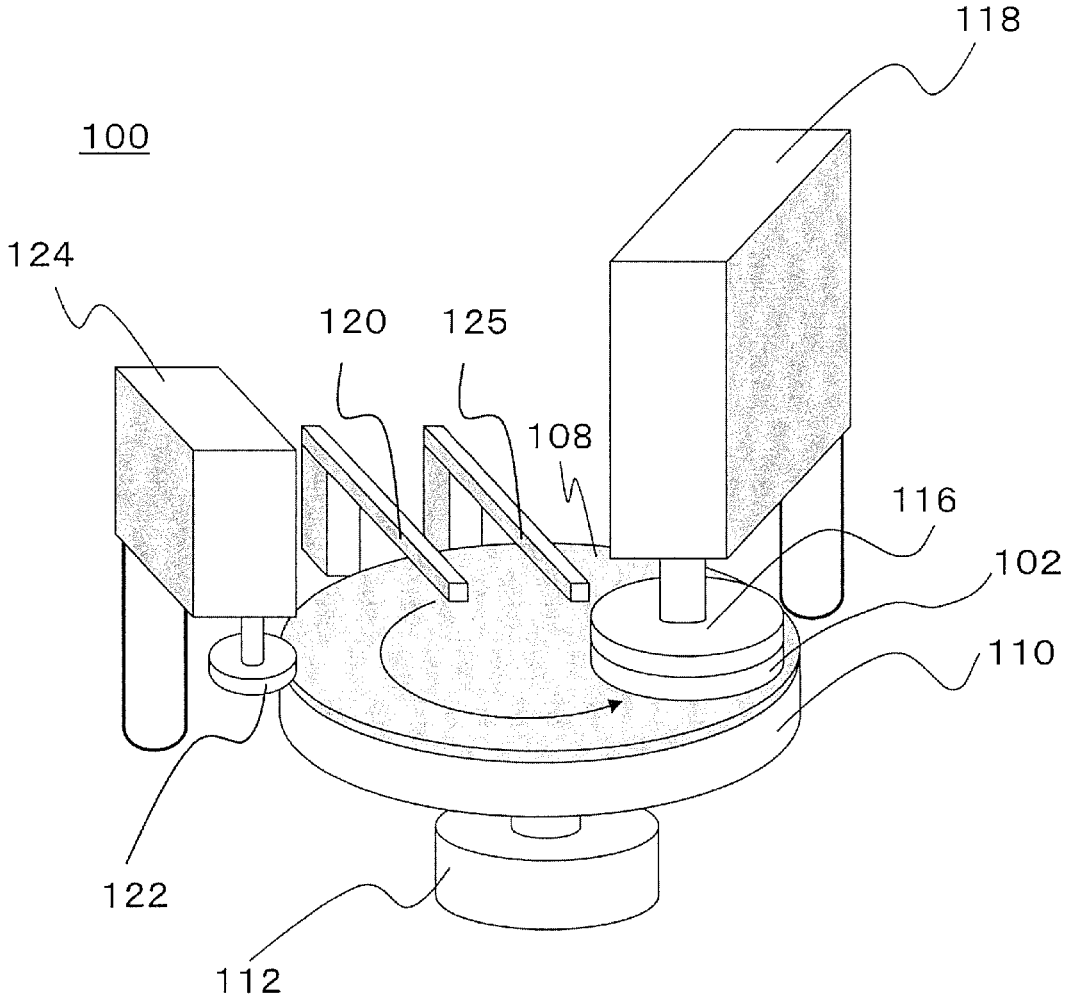
FIG. 1 is a perspective view schematically showing a configuration of a polishing apparatus.

FIG. 1 is a perspective view schematically showing a general configuration of a polishing apparatus. As shown in FIG. 1, a polishing apparatus 100 includes a polishing table 110 with an upper surface on which a polishing pad 108 for polishing a substrate 102 such as a semiconductor wafer can be mounted, and a first electric motor (driving section) 112 that rotationally drives the polishing table 110. The polishing apparatus 100 further includes a top ring (substrate holding section) 116 which pressurizes the substrate 102 to press the polishing pad 108 during polishing of the substrate 102 and which sucks and lifts the substrate 102 during lifting of the substrate 102, and a second electric motor 118 that rotationally drives the top ring 116.

Furthermore, the polishing apparatus 100 includes a slurry line (grinding liquid feeding section) 120 that can feed a polishing and grinding liquid containing a polishing material onto an upper surface of the polishing pad 108, and a dresser unit 124 with a dresser disk 122 that carries out conditioning (dressing) on the polishing pad 108. The polishing apparatus 100 further includes a DIW (De-Ionized Water) line (cleaning liquid feeding section) 125 that feeds a cleaning liquid for substrate cleaning onto the polishing pad 108. The slurry line (grinding liquid feeding section) 120 and the DIW line (cleaning solution feeding section) 125 have a function of a liquid feeding section to feed a liquid onto a polishing surface of the polishing pad 108. The top ring 116 has a function to suck and convey the substrate 102 in a direction away from the polishing surface, the substrate 102 being disposed on (or contacting) the polishing surface via the liquid fed onto the polishing surface of the polishing pad 108 by the liquid feeding section.

To polish the substrate 102, the polishing apparatus 100 feeds the polishing and grinding liquid containing a polishing material onto the upper surface of the polishing pad 108 through the slurry line 120 and rotationally drives the polishing table 110 by the first electric motor 112. Then, the top ring 116 is rotated at a position that is eccentric to the axis of rotation of the polishing table 110. In this state, the substrate 102 held by the top ring 116 is pressed against the polishing pad 108. Thus, the substrate 102 is polished and flattened by the polishing pad 108.

First Embodiment

Figure 2:
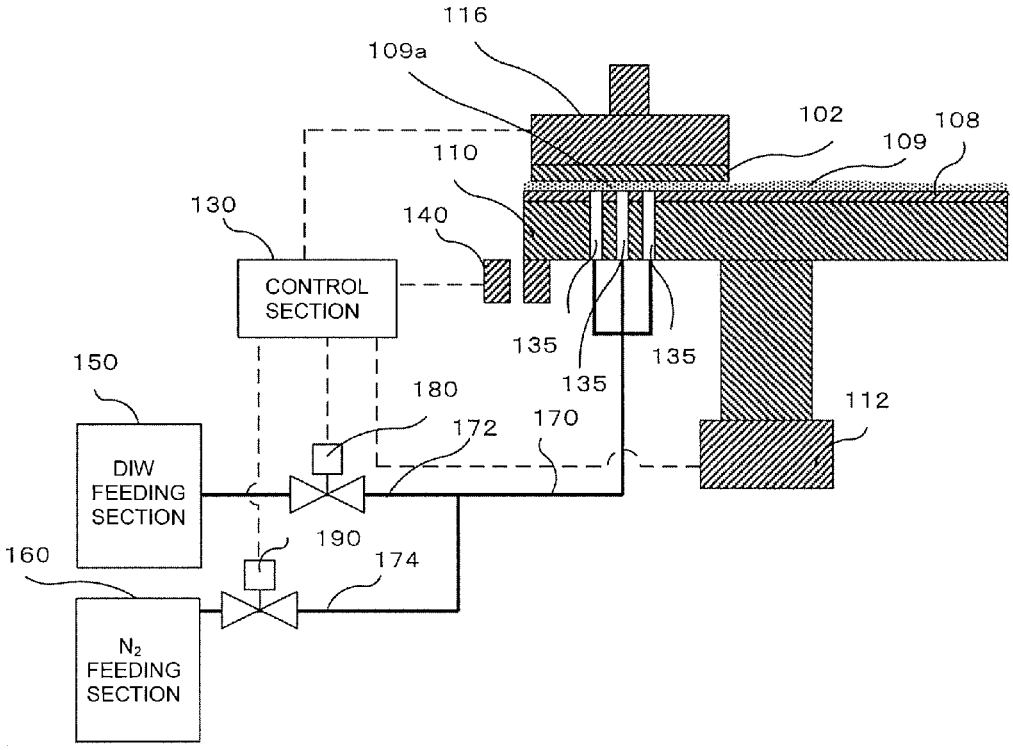
FIG. 2 is a diagram schematically showing a configuration of a polishing apparatus according to a first embodiment.

Now, a polishing apparatus according to a first embodiment will be described. FIG. 2 is a diagram schematically showing a configuration of the polishing apparatus according to the first embodiment. As shown in FIG. 2, the polishing apparatus 100 includes a control section 130 that performs control related to polishing and lifting of the substrate 102 and a position detecting sensor 140 that detects a rotational position of the polishing table 110.

The polishing apparatus 100 further includes a DIW feeding section 150 that feeds pure water (DIW) between the substrate 102 and the polishing pad 108 and an $N_2$ feeding section 160 that feeds $N_2$ (a gas) between the substrate 102 and the polishing pad 108.

As shown in FIG. 2, communication holes 135 are formed in the polishing pad 108 and in the polishing table 110 to allow the polishing surface of the polishing pad 108 to communicate with a back surface of the polishing table 110. The communication holes 135 can be formed by forming holes in the polishing table 110 and in the polishing pad 108 and attaching the polishing pad 108 to the polishing table 110 so that the holes in the polishing pad 108 align with the holes in the polishing table 110. FIG. 2 shows an example in which three communication holes 135 are formed, but the number of communication holes 135 is not limited to this. One or more communication holes 135 may be provided. An increased number of communication holes 135 are advantageous for the capability of lifting the substrate but affect polishing. Thus, the number of communication holes 135 may be minimized. Furthermore, an increased size of the communication hole 135 is advantageous for the capability of lifting the substrate but affect polishing. Hence, the size of the communication hole 135 may be minimized.

One end of a gas liquid conveying line 170 through which a gas or a liquid is conveyed is provided at a bottom portion of each of the communication holes 135. The other end of the gas liquid conveying line 170 branches into two lines extending in respective directions; one of the lines, a liquid conveying line 172, is connected to the DIW feeding section 150, and the other line, a gas conveying line 174, is connected to the $N_2$ feeding section 160.

The liquid conveying line 172 includes an on-off valve 180 provided therein so as to be able to open and close the liquid conveying line 172. Furthermore, the gas conveying line 174 includes an on-off valve 190 provided therein so as to be able to open and close the gas conveying line 174.

The control section 130 has a function to allow a gas to be injected between the substrate 102 and the polishing pad 108 when the substrate 102 is being lifted (conveyed). That is, during polishing of the substrate 102, a polishing and grinding liquid is fed onto the polishing pad 108 via the slurry line 120, and polishing is carried out with the polishing and grinding liquid interposed between the polishing pad 108 and the substrate 102. Subsequently, pure water may be fed onto the polishing pad 108 via the DIW line 125 in order to clean the substrate 102. In any case, the step of lifting the substrate 102 is carried out with a liquid (polishing and grinding liquid or pure water) 109 interposed between the substrate 102 and the polishing pad 108. The control section 130 allows a gas to be injected into an internal area 109*a* of the liquid 109 (polishing and grinding liquid or pure water) interposed between the substrate 102 and the polishing pad 108. Furthermore, the control section 130 is not limited to this aspect but may inject the gas between the polishing pad 108 and the liquid 109 or between the liquid 109 and the substrate. The gas is, for example, $N_2$ or air. However, the gas is not limited to such gases but may use an inert gas. Furthermore, the control section 130 is not limited to inject the gas but may inject a fluid such as a liquid between the substrate 102 and the polishing pad 108.

To lift the substrate 102, the control section 130 first aligns the substrate 102 with the communication holes 135. Specifically, the control section 130 can rotate the polishing table 110 so as to place the communication holes 135 opposite a plate surface (front surface) of the substrate 102 based on the rotational position of the polishing table 110 detected by the position detecting sensor 140. With the communication holes 135 opposite to the plate surface of the substrate 102, the control section 130 injects the gas into the internal area 109*a* of the polishing and grinding liquid or pure water interposed between the substrate 102 and the polishing pad 108.

More specifically, the control section 130 can open and close the on-off valve 190 by outputting an open/close signal to the on-off valve 190. During lifting of the substrate 102, by controllably "opening" the on-off valve 190, the control section 130 can inject the gas into the internal area 109*a* of the polishing and grinding liquid and pure water interposed between the substrate 102 and the polishing pad 108 via the gas conveying line 174, the gas and liquid conveying line 170, and the communication holes 135.

As described above, a vacuum region generated between the substrate 102 and the polishing pad 108 can be broken by injecting the gas into the internal area 109*a* of the polishing and grinding liquid and pure water interposed between the substrate 102 and the polishing pad 108. This makes the vacuum pressure between the top ring 116 and the substrate 102 higher than the vacuum pressure between the substrate 102 and the polishing pad 108. Thus, the suction force between the top ring 116 and the substrate 102 becomes stronger than the suction force between the substrate 102 and the polishing pad 108. As a result, the substrate 102 sucked to the top ring 116 is lifted up and can thus be prevented from being left on the polishing pad 108. The specification assumes that the suction force between two objects increases consistently with the increase of vacuum pressure between the objects.

On the other hand, after the gas is injected between the substrate 102 and the polishing pad 108 via the communication holes 135 and the substrate 102 is then lifted, the control section 130 can stop injecting the gas and then inject a liquid into the communication holes 135.

Specifically, the control section 130 can open and close an on-off valve 180 by outputting an open/close signal to the on-off valve 180. After the substrate 102 is lifted, the control section 130 can inject pure water into the communication holes 135 via the liquid conveying line 172 and the gas and liquid conveying line 170 by controllably opening the on-off valve 180. Thus, the inside of the communication holes 135 can be cleaned after the substrate 102 is lifted. Furthermore, storing pure water in the communication holes 135 during polishing allows possible entry of slurry into the communication holes 135 to be prevented and enables a reduction in adverse effects on polishing performance.

Now, an aspect of formation of the communication holes will be described. FIG. 3 is a diagram illustrating an example of formation of the communication holes. FIG. 3 schematically shows a position where the communication holes 135 are formed and the position of the substrate 102, when the polishing pad 108 is viewed from above.

As shown in FIG. 3, the communication holes 135 can be formed in various manners. FIG. 3A corresponds to the communication holes 135 shown in FIG. 2 and shows the three communication holes 135 arranged generally in a central portion of the substrate 102. Alternatively, as shown in FIG. 3B, the three communication holes 135 may be collectively arranged around a peripheral portion of the substrate 102.

Figure 3A:
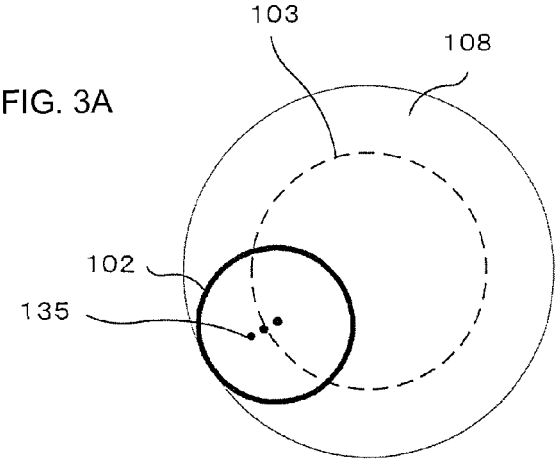
FIGS. 3A, 3B, 3C, 3D and 3E are diagrams illustrating an example of formation of communication holes.
Figure 3B:
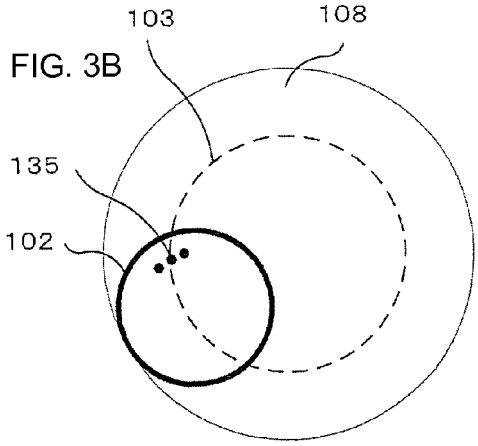
Figure 3C:
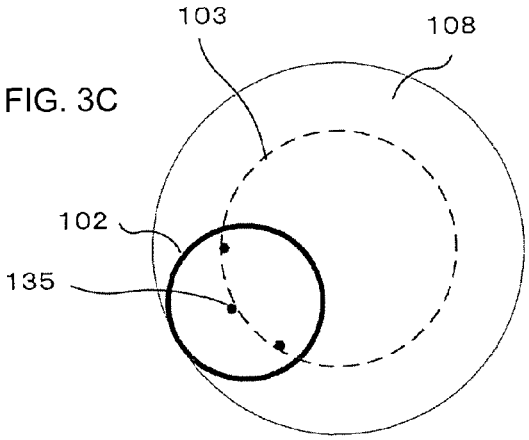
Figure 3D:
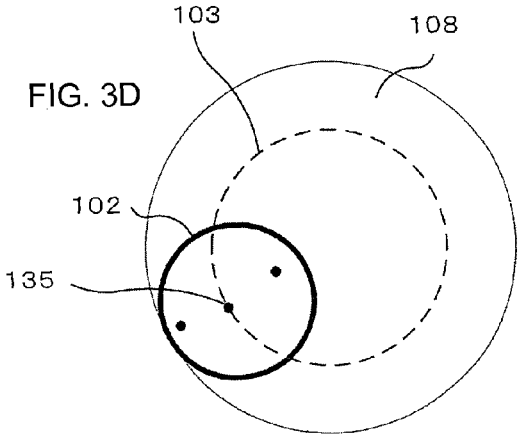
Figure 3E:
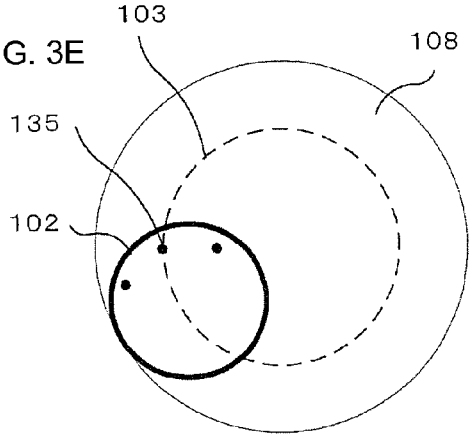

Alternatively, as shown in FIG. 3C, the communication holes 135 may be arranged away from one another along a transition line 103 schematically showing a trajectory followed by the center of the substrate 102 when the polishing table 110 is rotated. Alternatively, as shown in FIG. 3D, the communication holes 135 may be arranged away from one another in a direction crossing the transition line 103. Alternatively, as shown in FIG. 3E, the communication holes 135 may be arranged around the peripheral portion of the substrate 102 and away from one another in the direction crossing the transition line 103. In FIG. 3, at least one communication hole 135 is arranged on the transition line 103. However, the communication holes 135 are not limited to this. The communication holes 135 are not need to be arranged on the transition line 103.

Figure 4:
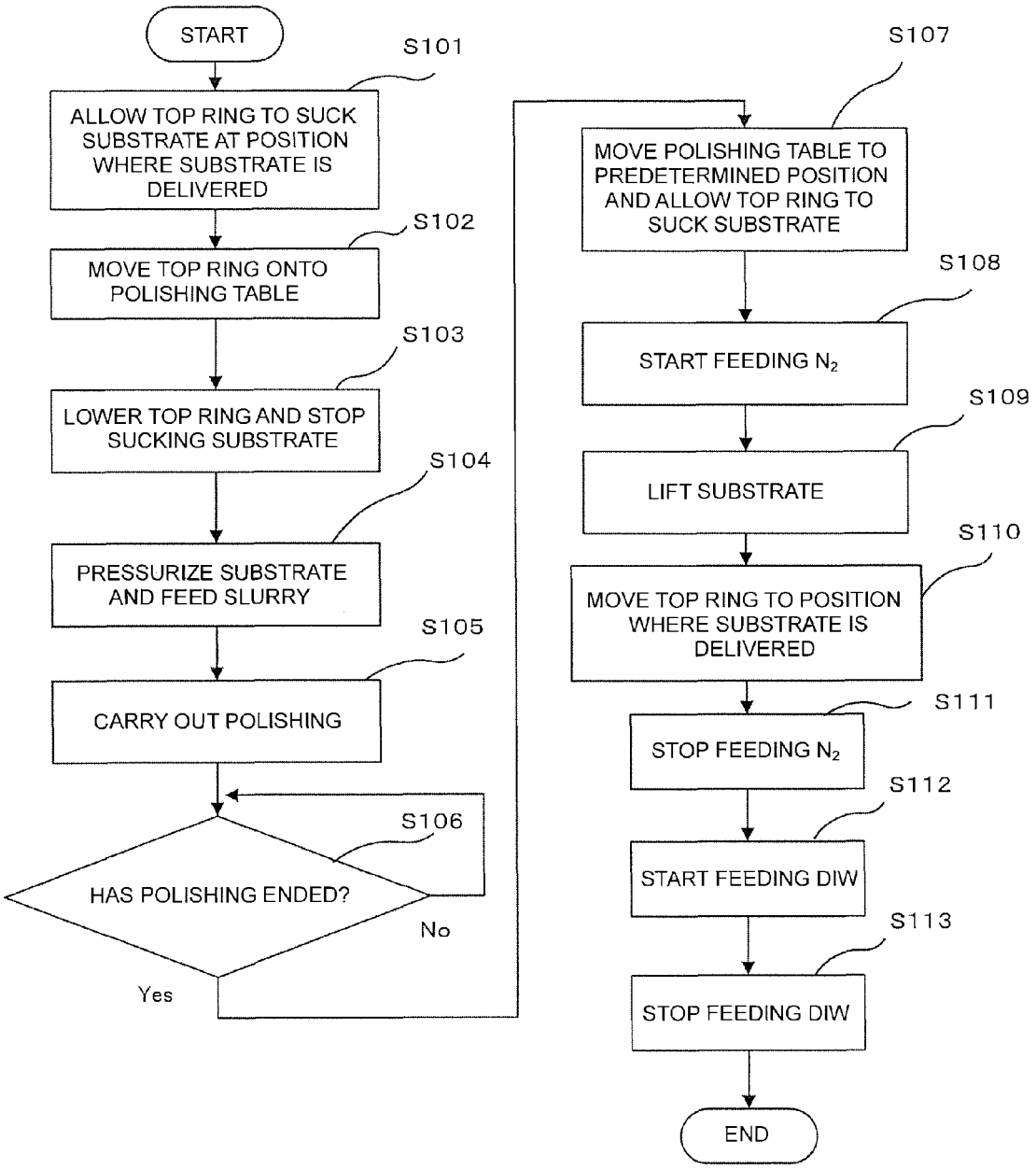
FIG. 4 is a diagram showing a process flow for the polishing apparatus.

Now, a process flow for the polishing apparatus 100 will be described. FIG. 4 is a diagram showing the process flow for the polishing apparatus. FIG. 5 is a diagram schematically showing processes of polishing and lifting the substrate by the polishing apparatus. The process flow in FIG. 4 is an example in which polishing of the substrate 102 is first carried out and followed by lifting of the substrate 102. However, cleaning of the substrate 102 may be carried out between the polishing of the substrate 102 and the lifting of the substrate 102.

As shown in FIG. 4, the control section 130 allows the substrate 102 to be sucked to the top ring 116 at a position where the substrate is delivered (step S101). The control section 130 subsequently moves the top ring 116 onto the polishing table 110 (polishing pad 108) (step S102).

Figure 5A:
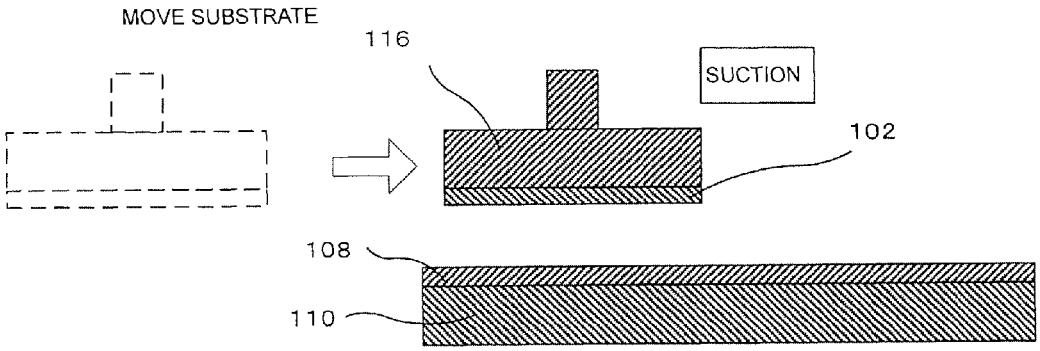
FIGS. 5A, 5B, 5C and 5D are diagrams schematically showing processes of polishing and lifting a substrate by the polishing apparatus.

This state is shown in FIG. 5A. As shown in FIG. 5A, the top ring 116 with the substrate 102 sucked thereto is moved onto the polishing pad 108.

Subsequently, the control section 130 lowers the top ring 116 and stops sucking the substrate 102 (step S103). Thus, the substrate 102 is placed on the polishing pad 108.

Subsequently, the control section 130 pressurizes the substrate 102 by the top ring 116 and feeds slurry onto the polishing pad 108 (step S104). Feeding of slurry may be started before the substrate 102 is placed on the polishing pad 108. The control section 130 subsequently polishes the substrate 102 (step S105). Specifically, the control section 130 rotates the polishing table 110 and the top ring 116 while pressurizing the substrate 102 by the top ring 116.

Figure 5B:
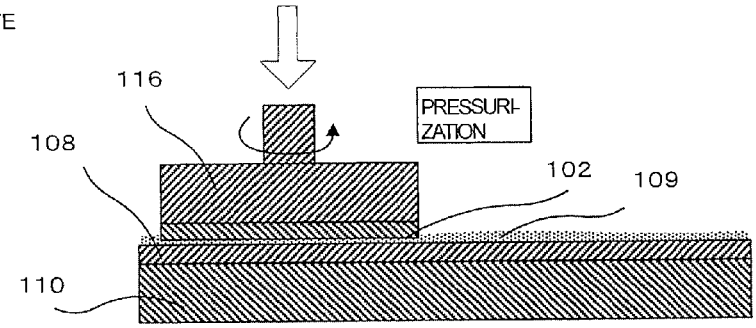

This state is shown in FIG. 5B. As shown in FIG. 5B, the substrate 102 is pressed against the polishing pad 108 by the top ring 116 and polished with a polishing and grinding liquid in conjunction with the rotation of the polishing table 110 and the top ring 116. When pure water is fed into the communication holes 135 during polishing of the substrate 102, the polishing and grinding liquid can be prevented from entering the communication holes 135. However, feeding of a large amount of pure water leads to the mixture of the pure water into the polishing and grinding liquid. Thus, the pure water may be fed into the communication holes 135 in an amount sufficient to prevent possible entry of the polishing and grinding liquid into the communication holes 135. A monitoring device for monitoring a polished state of the polished surface of the substrate 102 during polishing may be further provided in the communication holes 135. During measurement by the monitoring device, the polishing and grinding liquid can be prevented from entering a space between the substrate 102 and the monitoring device by filling the communication holes 135 with water (pure water). Therefore, the gas and liquid conveying line 170 may be connected to the communication holes 135 into which the monitoring device is provided.

Subsequently, the control section 130 determines whether or not the polishing has ended (step S106). Whether or not the polishing of the substrate 102 has ended can be determined, for example, based on a change in torque current through the first electric motor 112 or the second electric motor 118.

Upon determining that the polishing of the substrate 102 has not ended (No in step S106), the control section 130 repeats the polishing process until the control section 130 determines that the polishing has ended. On the other hand, upon determining that the polishing of the substrate 102 has ended (Yes in step S106), the control section 130 moves the polishing table 110 to a predetermined position, and allows the top ring 116 to suck the substrate 102 (step S107). The control section 130 subsequently starts feeding $N_2$ through the communication holes 135 (step S108). An order of step S107 and step S108 can be reversed.

Figure 5C:
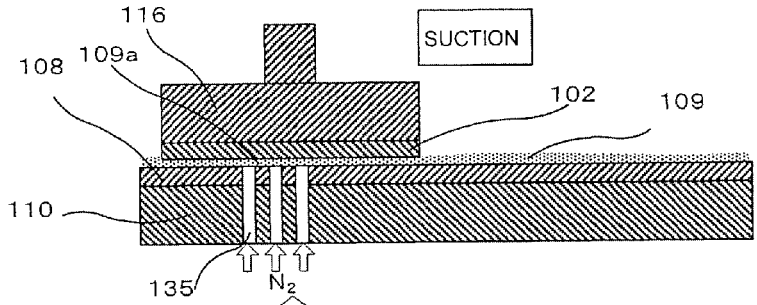

This state is shown in FIG. 5C. The control section 130 rotates the polishing table 110 so as to place the communication holes 135 opposite the plate surface of the substrate 102, as shown in FIG. 5C, based on the rotational position of the polishing table 110 detected by the position detecting sensor 140. The control section 130 also allows the top ring 116 to suck the substrate 102. The process of moving the polishing table 110 to the predetermined position may be carried out before or after the process of allowing the top ring 116 to suck the substrate 102. The control section 130 then feeds $N_2$ from bottom portions of the communication holes 135 as shown in FIG. 5C.

Thus, $N_2$ can be fed into the internal area 109*a* of the polishing and grinding liquid interposed between the substrate 102 and the polishing pad 108. As a result, a vacuum region generated between the substrate 102 and the polishing pad 108 can be broken.

Subsequently, the control section 130 lifts the substrate 102 (step S109). Specifically, the control section 130 moves the top ring 116 upward with the substrate 102 sucked thereto to lift the substrate 102.

Figure 5D:
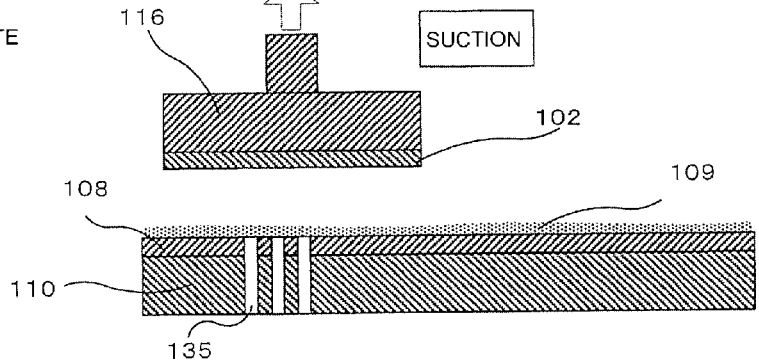

This state is shown in FIG. 5D. When the vacuum region generated between the substrate 102 and the polishing pad 108 is broken, the vacuum pressure between the substrate 102 and the polishing pad 108 becomes lower than the vacuum pressure between the top ring 116 and the substrate 102. As a result, the suction force between the top ring 116 and the substrate 102 becomes stronger than the suction force between the substrate 102 and the polishing pad 108. Thus, the substrate 102 sucked to the top ring 116 is lifted up and can thus be prevented from being left on the polishing pad 108.

Furthermore, the first embodiment avoids slidable movement of the substrate 102 along the polishing surface. This allows the substrate 102 to be restrained from being scratched (flawed). The first embodiment also avoids an increase in duration for which the substrate 102 is sucked to the polishing pad 108. This allows polishing throughput to be restrained from decreasing. As a result, the capability of lifting the substrate 102 can be improved with the polishing performance of the substrate 102 maintained.

Subsequently, the control section 130 moves the top ring 116 to a position where the substrate 102 is delivered (step S110). The control section 130 then shifts to a step of cleaning the communication holes 135. That is, the control section 130 stops feeding $N_2$ (step S111) and starts feeding DIW (pure water) to the communication holes 135 (step S112). This allows slurry and polishing chips attached to the communication holes 135 to be cleaned. Then, the control section 130 stops feeding the DIW (step S113) and ends the process. After moving the top ring 116 to the position where the substrate 102 is delivered, the control section 130 repeats a similar process on the next substrate to be polished starting with step S101.

Second Embodiment

Figure 6A:
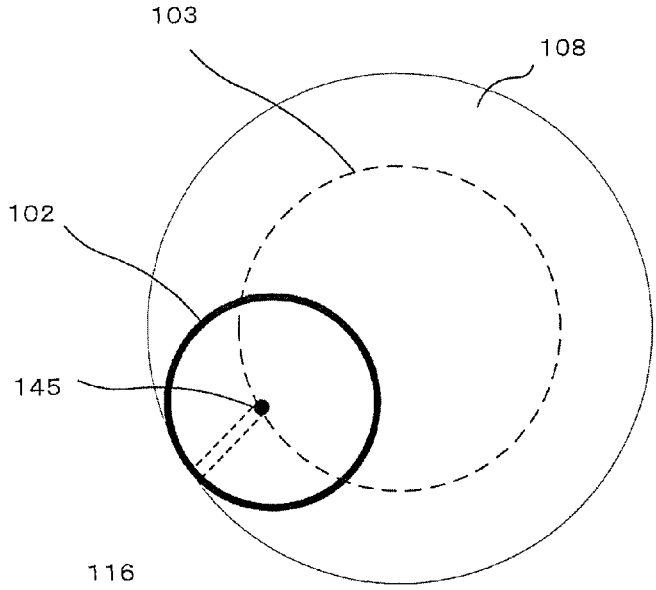
FIGS. 6A and 6B are diagrams schematically showing a configuration of a polishing apparatus according to a second embodiment.
Figure 6B:
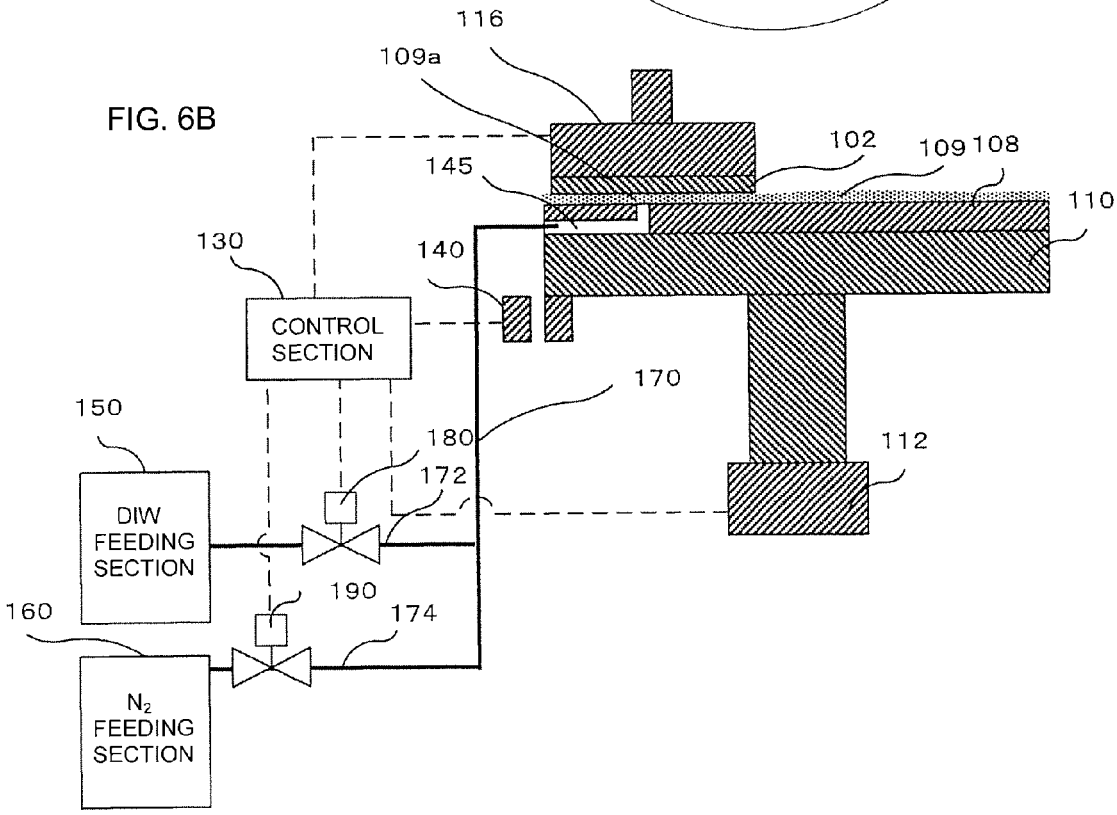

Now, a polishing apparatus according to a second embodiment will be described. FIG. 6 is a diagram schematically showing a configuration of the polishing apparatus according to the second embodiment. FIG. 6A schematically shows a position where a communication hole 145 is formed and a position of a substrate 102, when a polishing pad 108 is viewed from above. FIG. 6B is a diagram schematically showing a configuration of the polishing apparatus according to the second embodiment. The second embodiment is different from the first embodiment only in the manner of formation of the communication hole. Thus, description of the other components is omitted.

As shown in FIG. 6A and FIG. 6B, the communication hole 145 is formed by cutting out the polishing pad 108 so that a polishing surface of the polishing pad 108 is in communication with a side surface of the polishing pad 108. FIG. 6 shows an example in which the single communication hole 145 is formed. However, the number of communication hole is not limited to this. For example, a plurality of the communication holes 145 may be formed along a circumferential direction of the polishing pad 108.

According to the second embodiment, during lifting of the substrate 102, the control section 130 allows a gas to be injected into an internal area of a polishing and grinding liquid or pure water interposed between the substrate 102 and the polishing pad 108 via the communication hole 145, as is the case with the first embodiment. Thus, a vacuum region generated between the substrate 102 and the polishing pad 108 can be broken. This makes the vacuum pressure between the substrate 102 and the polishing pad 108 lower than the vacuum pressure between a top ring 116 and the substrate 102. As a result, the suction force between the top ring 116 and the substrate 102 becomes stronger than the suction force between the substrate 102 and the polishing pad 108. Consequently, the substrate 102 sucked to the top ring 116 is lifted up and can thus be prevented from being left on the polishing pad 108. Furthermore, the second embodiment eliminates the need to form a communication hole in a polishing table 110. Thus, versatility of the polishing apparatus can be improved. The second embodiment also eliminates the need to align the hole when the polishing pad 108 is attached to the polishing table 110. Hence, manufacture of a polishing apparatus 100 can be facilitated.

Furthermore, the second embodiment avoids slidable movement of the substrate 102 along the polishing surface. This allows the substrate 102 to be restrained from being scratched (flawed). The second embodiment also avoids an increase in duration for which the substrate 102 is sucked to the polishing pad 108. This allows polishing throughput to be restrained from decreasing. As a result, the capability of lifting the substrate 102 can be improved with the polishing performance of the substrate 102 maintained.

Third Embodiment

Figure 7A:
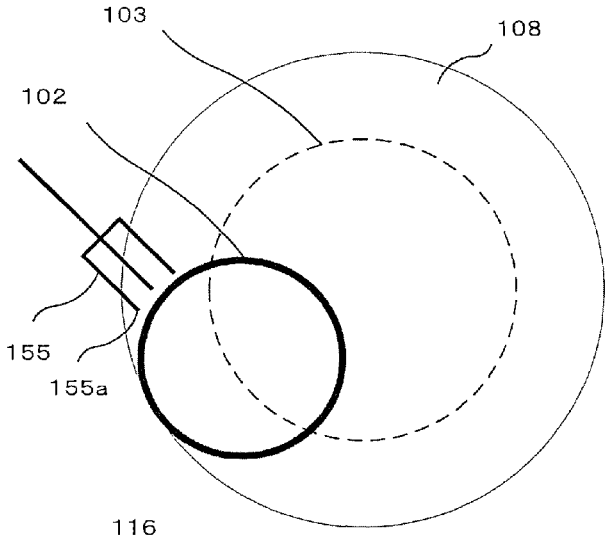
FIGS. 7A and 7B are diagrams schematically showing a configuration of a polishing apparatus according to a third embodiment.
Figure 7B:
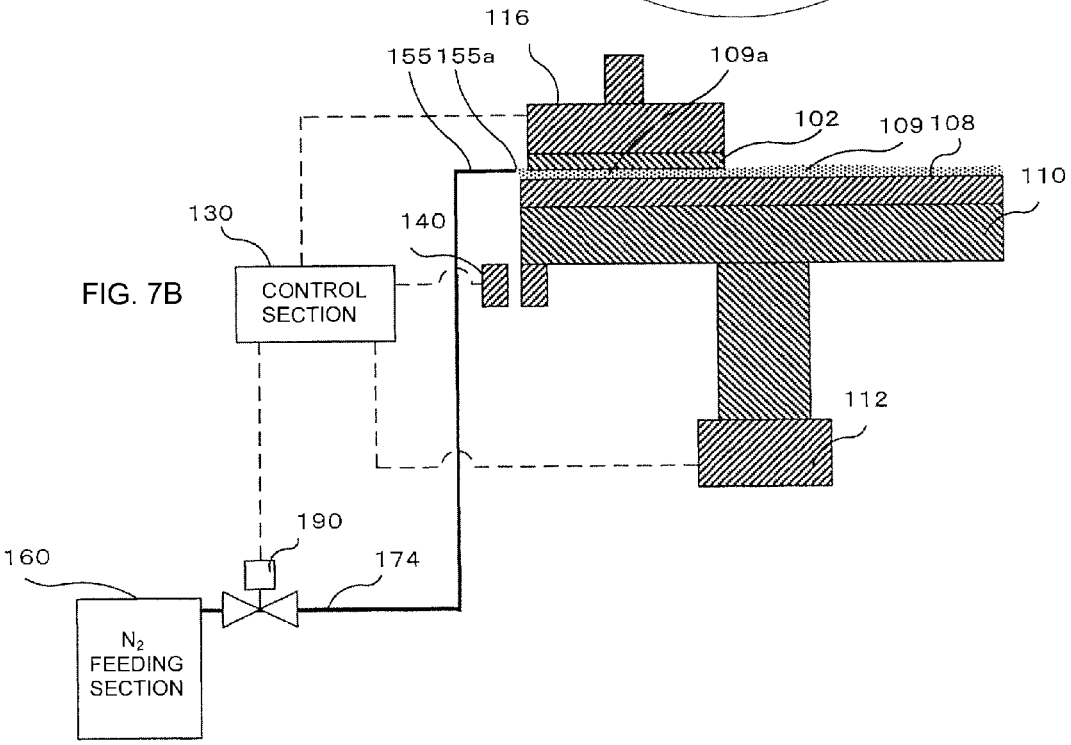

Now, a polishing apparatus according to a third embodiment will be described. FIG. 7 is a diagram schematically showing a configuration of the polishing apparatus according to the third embodiment. FIG. 7A schematically shows a position of a nozzle 155 and a position of a substrate 102, when a polishing pad 108 is viewed from above. FIG. 7B is a diagram schematically showing a configuration of the polishing apparatus according to the third embodiment. The third embodiment is different from the first embodiment and the second embodiment chiefly in that no communication hole is formed and that a gas is injected through a nozzle directly into an internal area of a polishing and grinding liquid or pure water interposed between the substrate 102 and the polishing pad 108. Components of the third embodiment which are the same as the corresponding components of the first and second embodiments will not be described below.

As shown in FIG. 7A and FIG. 7B, the nozzle 155 connected to a gas conveying line 174 so as to be able to discharge a gas is provided at a position opposite to a polishing surface of the polishing pad 108, a position outside an outer peripheral portion of a polishing table 110, or a position outside an outer peripheral portion of the substrate 102. The nozzle 155 includes a gas discharge port 155*a* that can be disposed to face the internal area of the polishing and grinding liquid or pure water interposed between the substrate 102 and the polishing pad 108. Thus, a gas discharged through the gas discharge port 155*a* can be injected into the internal area of the polishing and grinding liquid or pure water interposed between the substrate 102 and the polishing pad 108.

According to the third embodiment, during lifting of the substrate 102, a control section 130 allows a gas to be injected into the internal area of the polishing and grinding liquid or pure water interposed between the substrate 102 and the polishing pad 108. Thus, a vacuum region generated between the substrate 102 and the polishing pad 108 can be broken. This makes the vacuum pressure between the substrate 102 and the polishing pad 108 lower than the vacuum pressure between a top ring 116 and the substrate 102. As a result, the suction force between the top ring 116 and the substrate 102 becomes stronger than the suction force between the substrate 102 and the polishing pad 108. Consequently, the substrate 102 sucked to the top ring 116 is lifted up and can thus be prevented from being left on the polishing pad 108. The third embodiment includes no communication hole and thus eliminates the need for a liquid conveying line 172, an on-off valve 180, and the like, which are configured to clean the communication hole. Furthermore, according to the third embodiment, no communication hole needs to be formed in a polishing table 110 or the polishing pad 108. This allows the versatility of the polishing apparatus to be improved.

Additionally, the third embodiment avoids slidable movement of the substrate 102 along the polishing surface. This allows the substrate 102 to be restrained from being scratched (flawed). The third embodiment also avoids an increase in duration for which the substrate 102 is sucked to the polishing pad 108. This allows polishing throughput to be restrained from decreasing. As a result, the capability of lifting the substrate 102 can be improved with the polishing performance of the substrate 102 maintained.

What is claimed is:

1. A polishing apparatus comprising:

a polishing table to which a polishing pad for polishing a substrate is attached;

a liquid feeding section configured to feed a liquid to a polishing surface of the polishing pad;

a substrate holding section configured to suck and convey the substrate from the polishing surface, the substrate contacting the polishing surface via the liquid fed by the liquid feeding section;

a control section configured to inject a fluid between the substrate and the polishing pad when the substrate is being conveyed;

a communication hole is formed in the polishing pad and in the polishing table to allow the polishing surface of the polishing pad to communicate with a side surface or a back surface of the polishing table, and the control section injects the fluid between the substrate and the polishing pad via the communication hole, wherein the polishing apparatus further comprising:

a driving section configured to rotate the polishing table; and a position detecting sensor configured to detect a rotational position of the polishing table, wherein the control section rotates the polishing table so as to place the communication hole opposite a surface of the substrate based on the rotational position of the polishing table detected by the position detecting sensor, and in this state, the control section injects the fluid between the substrate and the polishing pad via the communication hole.

* * * * *